US005418606A

United States Patent [19]

Kikuchi et al.

[11] Patent Number: 5,418,606

[45] Date of Patent: May 23, 1995

[54] IMAGE FORMING APPARATUS WITH SIDEWAYS U-SHAPED SHEET PATH

[75] Inventors: Yutaka Kikuchi; Seiji Sagara, both of Kawasaki; Yuzo Isoda, Yokohama, all of Japan

[73] Assignee: Canon Kabushiki Kaisha, Tokyo, Japan

[21] Appl. No.: 147,424

[22] Filed: Nov. 5, 1993

Related U.S. Application Data

[63] Continuation of Ser. No. 657,386, Feb. 19, 1991, abandoned, which is a continuation of Ser. No. 365,779, Jun. 14, 1989, abandoned.

[30] Foreign Application Priority Data

Jun. 17, 1988 [JP] Japan ..... 63-149660
Jun. 17, 1988 [JP] Japan ..... 63-149661
Jun. 17, 1988 [JP] Japan ..... 63-149662

[51] Int. Cl.[6] ..... G03G 15/00
[52] U.S. Cl. ..... 355/309; 355/318
[58] Field of Search ..... 355/308, 309, 210, 211, 355/318, 317, 321, 311; 271/3.1, 162, 198, 306

[56] References Cited

U.S. PATENT DOCUMENTS 4,147,426 4/1979 Miyoshi et al. ..... 355/309
4,664,504 5/1987 Oda et al. ..... 355/270 X
4,750,016 6/1988 Ksumoto et al. .
4,864,368 9/1989 Muramatsu ..... 355/309
5,002,266 3/1991 Kikuchi et al. ..... 271/3

FOREIGN PATENT DOCUMENTS 0255713 2/1988 European Pat. Off. .
0276910 8/1988 European Pat. Off. .
0285139 10/1988 European Pat. Off. .
0322818 7/1989 European Pat. Off. .
0330225 8/1989 European Pat. Off. .
0331324 9/1989 European Pat. Off. .
3715119 11/1987 Germany .
59-005251 1/1984 Japan .
57-077450 5/1984 Japan .
60-104958 6/1985 Japan .
60-258030 12/1985 Japan .
61-56371 3/1986 Japan .
0239171 10/1987 Japan ..... 355/313
63-15265 1/1988 Japan .
63-015265 1/1988 Japan .
2189196 10/1967 United Kingdom .

*Primary Examiner*—A. T. Grimley
*Assistant Examiner*—T. A. Dang
*Attorney, Agent, or Firm*—Fitzpatrick, Cella, Harper & Scinto

[57] ABSTRACT

The present invention relates to an image forming apparatus in which a sheet material is fed from a sheet feeding unit to an image forming unit for image formation on the sheet material, and the sheet material is transported and discharged to a sheet discharge unit after image formation. The image forming apparatus includes a substantially horizontal sheet feeding unit provided at either of an upper position and a lower position of the image forming unit at the center, and a substantially horizontal sheet discharge unit provided at the other of the positions; and a sheet path extending substantially vertically from the sheet feeding unit through the image forming unit to the sheet discharge unit.

26 Claims, 12 Drawing Sheets

IMAGE FORMING APPARATUS WITH SIDEWAYS U-SHAPED SHEET PATH

This application is a continuation of application Ser. No. 07/657,386, filed Feb. 19, 1991, which is a continuation of parent application Ser. No. 07/365,779, filed Jun. 14, 1989, both now abandoned.

BACKGROUND OF THE INVENTION

1. Field of the Invention

The present invention relates to an image forming apparatus, and more particularly an image forming apparatus such as a copying machine or a printer in which a sheet material (a cut sheet such as a transfer sheet, an electrostatic recording sheet, an electrofax sheet, a photosensitive sheet, a printing sheet etc.) is fed one by one from a sheet feeder unit to image forming means functioning in a suitable imaging process such as an electrophotographic process, an electrostatic recording process or a magnetic recording process for formation of an object image by a transfer (indirect) method or a direct method, and the sheet material bearing the formed image is transported or conveyed to a sheet discharge unit.

2. Related Background Art

FIGS. 1 and 2 are schematic views of examples of the above-mentioned image forming apparatus, both being laser beam printers utilizing image-transfer electrophotographic process.

Referring to FIG. 1, a main body 100 of the printer houses image forming means to be explained in the following. An electrophotographic photosensitive member 101 formed as a rotary drum (hereinafter simply referred to as "drum") is subjected, in the rotation thereof, to scanning exposure with a laser beam L (modulated corresponding to time-sequential electrical pixel signals of an object image entered from a computer, a word processor or an image reader which is not illustrated) from a laser scanner unit 103, thereby forming an electrostatic latent image corresponding to said object image. A mirror 103*a* serves to deflects the laser beam L from the scanner 103 toward the scanning exposure position of the drum 101. The latent image formed on the drum is developed, in a developing unit 104, into a visible transferrable toner image.

In a sheet feed slot 105 provided on the right-hand face of the main body 100, a sheet cassette 106 is inserted, with stacked sheet materials P therein. The uppermost sheet thereof alone is separated and fed into the printer by means of an intermittently driven sheet feed roller 107 and a separating finger 108. The sheet material advances through a sheet path 109, and the leading end of the sheet is received by the nip portion of paired registration rollers 110 which are stopped at this moment. Then, in response to the activation of said registration rollers 110, the sheet is forwarded, through a sheet path 111, to an image transfer station 113.

In said image transfer station 113, said sheet material receives the transfer of the toner image from the drum 101 in sequential manner, then separated from said drum 101, transported by a conveyor 114 to a fixing unit 115, and subjected to image fixation while it passes through said fixing unit 115.

The sheet material coming out of the fixing station 115 is transported by first discharge rollers 117, then guided by the lower side of a flapper 118 maintained in the solid-lined first position, and is discharged, with the image bearing face upwards, on a face-up discharge tray 119 extended from the left-hand face of the main body. On the other hand, when the movable flapper is not in the solid-lined first position but in a chain-lined second position, the sheet material after fixing, coming out of the first discharge rollers 117, is deflected upwards as guided by the upper inclined face of the movable flapper 118, then passes through a substantially vertical sheet path 120 provided with transport rollers 120*a*, and is discharged by second discharge rollers 121 at the upper end of said sheet path, with the image-bearing face downwards, on a face-down discharge tray 122 provided on the upper face of the main body. A sheet 116 is provided in the sheet path between the fixing unit 115 and the first discharge rollers 117. The first or second position of said movable flapper 118 is selected by a manual operation of a lever or a knob, according to the selection of the sheet discharge whether in a face-up mode or in a face-down mode.

A manual sheet insert slot 123 is provided on the right-hand face of the main body 100, above the sheet feed slot 105 into which the sheet cassette 106 is inserted, and a sheet guide plate 124 for manual sheet insertion extends externally from said manual sheet insert slot 123. When a sensor 125 detects the insertion of a sheet material, a signal from said sensor activates paired sheet feed rollers 126 to feed the sheet material into the printer, and said sheet is transported to the registration rollers 110 through a sheet path 127. Thereafter the sheet material is transported in the printer and subjected to image transfer and fixation in the same manner as the sheet material separated and transported from the aforementioned sheet cassette 106, and is discharged to the face-up discharge tray 119 or the face-down discharge tray 122.

The printer of the present embodiment is provided with so-called detachable process cartridge. The drum 101, primary charger 102, developing unit 104 and cleaning unit 128 are incorporated with a predetermined mutual relationship in a common cartridge housing constituting a process cartridge 130 which is detachably mounted in the printer.

In order to open the interior of the printer for the purposes of maintenance operations of the printer, mounting and dismounting of the process cartridge 130, removal of the sheet material jammed in the sheet path etc., there is employed so-called clam shell opening structure. More specifically the main body of the printer is divided into an upper half including the process cartridge 130, laser beam scanner 103 etc. and a lower half including the sheet cassette 106, transfer charger 112, conveyor 114, fixing unit 115 etc. with a mutual boundary along the substantially horizontal sheet path extending from the sheet feeding unit at the right side to the first discharge rollers at the left side, and the upper half can be rotated, as indicated by an arrow X, about a hinge 131 provided at the left-hand end, to a chain-lined position, thereby exposing the interior. This opening facilitates the maintenance inside the printer, mounting and detaching of the process cartridge 130 and removal of the jammed sheet material. Also the sheet jammed in the substantially vertical sheet path 120 extending from the movable flapper 118 to the second discharge rollers 121 can be removed by opening said sheet path 120, by rotating the left side plate 132 of the main body 100 about a hinge 133 provided at the lower portion of the plate 132, as indicated by an arrow Y, to a chain-lined position.

In a printer shown in FIG. 2, a sheet cassette storage unit for housing the sheet cassette 106 or a sheet stacking unit for stacking the sheet materials is provided below the image forming process units positioned along a substantially horizontal sheet path extending from the registration rollers 110 to the first discharge rollers 117. The upper-most one of the stacked sheet materials P is separated by the intermittently driven sheet feed roller 107 and the separating finger 108, and is transported to the registration rollers 110 through transport rollers 134 and a U-turn sheet path 135. The sheet material jammed in the U-turn sheet path 135 can be removed by opening said sheet path, by rotating an external guide plate 135*a* constituting said path to the outside about a hinge 135*b* provided at the lower side, as indicated by an arrow Z. The other structures of the printer, and the functions thereof, are similar to those in the printer shown in FIG. 1.

However, the conventional structures of the foregoing example are associated with following drawbacks.

(a) The printer shown in FIG. 1 is provided, on a lateral face of the main body 100 incorporating the image forming means, with sheet feeding units 106, 124, and with the sheet discharge unit 119 on the other lateral face, and the sheet material P from the sheet feed units is transported along the substantially horizontal sheet path extending in the main body from the sheet feed unit to the sheet discharge unit and is subjected to image formation by the image forming means 113 in the course of said transportation, before reaching the discharge unit. The image forming apparatus of such structure requires a large installation area, because the sheet cassette 106 and the manual sheet insertion guide plate 124 protrude from a side of the main body while the discharge tray 119 protrudes from the other side.

(b) On the other hand, the printer shown in FIG. 2 is free from such externally protruding parts, since the sheet feed unit 106 is positioned below the image forming means in the main body so that the sheet cassette 106 or the sheet stacking unit is almost entirely incorporated in the main body. However, the sheet material from said sheet feed unit 106 has to be guided to the horizontal sheet path of the image forming means positioned above through the U-turn sheet path 135. Thus the possibility of sheet jamming is higher because of the longer path length from the sheet feed unit to the discharge unit, and because the frequency of sheet jamming is higher in a U-shaped sheet path than in a straight sheet path. Also the jammed sheet handling process (removal of the jammed sheet) has to be conducted by rotational opening X of the horizontal sheet path and the opening operations Y, Z of the U-turn sheet path, and is difficult to conduct for the user.

(c) The apparatus shown in FIGS. 1 or 2 generally adopts the aforementioned clam shell structure, in which the main body of the apparatus is divided into an upper half and a lower half, and the upper half can be lifted from the lower half, for the purpose of opening the substantially horizontal sheet path of the image forming means. In such structure, if the discharge tray 122 is equipped on the upper face of the upper unit, the discharged sheet materials present on said tray will drop and be scattered by careless opening operation X of the upper half. Also together with the opening rotation of the upper half, the principal components of the image forming means, such as the process cartridge 130 and the laser beam scanner 103, equipped in said upper half are moved upwards, but such movement of the image forming means or the principal components thereof may lead to the deterioration of image quality as the mechanical precision of the apparatus is difficult to maintain.

Furthermore the conventional structure shown in FIG. 1 is associated with the following drawbacks.

(1) The sheet path length from the fixing unit 115 to the first discharge unit 122 is significantly different from the path length from said fixing unit 115 to the second discharge unit 119. Thus, in addition to the discharge rollers required at the first and second discharge slots, there are required plural pairs of transport rollers 120*a* in the former sheet path, for transporting a small-sized sheet such as a postcard. This fact not only leads to a limitation in the power transmission and an increased cost, but also requires a complicated opening structure for coping with the sheet jamming in the sheet path leading to the first discharge unit 122. There results a further increase of cost, for example by a sensor required for detecting the open state of said sheet path.

(2) Again, because the sheet path length from the fixing unit 115 to the first discharge unit 122 is significantly different from the path length to the second discharge unit 119, it is difficult to detect the secure discharge of the sheet material to the first or second discharge unit by a single sheet sensor 116 at the branching portion of said sheet paths. Consequently, there are required sheet sensors at the first and second discharge slots, and the electrical switching of first and second discharge units and the associated sequences and timing for jam detection, and these facts further raise cost.

Also in the foregoing conventional structure, the sheet cassette 106, manual sheet insert guide plate 124 and discharge tray 119, which are protruding from the main body of the apparatus, are cumbersome to handle and have to be removed at the storage or transportation of the apparatus.

In such case, the sheet feed slot 105 for inserting the cassette, the manual sheet insert-slot and the sheet discharge slot 119*a* are still open to the exterior, allowing intrusion of dusts or other foreign articles. Covers may be attached to these slots in order to prevent such dust intrusion, but such operation is cumbersome and may be easily forgotten. Particularly when the apparatus has the feed slots 105, 123 on a side and the discharge slot 119a on the opposite side, the cover attaching operations are even more cumbersome and more easily forgotten. Even if the slots on one side are covered, the covering of those on the other side may be forgotten. Also at the use of the apparatus, the operator may forget to uncover the discharge slot even after uncovering the sheet feed slots, and the apparatus causes sheet jamming at the discharge unit if a sheet material is fed by mistake. Consequently, such covering system is not practical. It is also difficult to optimize the sheet discharge path, by linking the selection of the sheet feed slots with that of the sheet discharge slots.

SUMMARY OF THE INVENTION

It is a first object of the present invention to provide an image forming apparatus of the above-explained type, not associated with the above-mentioned drawbacks.

It is a second object of the present invention to provide an image forming apparatus capable, in closing the sheet feed slots and discharge slots for preventing intrusion of the dust and other articles into the apparatus, of achieving the closing of said slots without error, avoiding the forgotten closing and other above-mentioned inconveniences.

(1) The present invention provides an image forming apparatus in which, as schematically shown in FIG. 3A, the sheet material is transported from a sheet feeding unit B to an image forming unit A for forming the object image on said sheet material, and the sheet material after image formation is transported to a sheet discharge unit C. The image forming unit A is positioned at the center, while the sheet feeding unit B is positioned at either of the upper and lower units and the sheet discharge unit C is positioned at the other. There is provided a substantially vertical sheet path D extending from the sheet feeding unit B, through the image forming unit A, to the sheet discharge unit C. The sheet material supplied from the sheet feeding unit B is introduced into said substantially vertical sheet path D, then subjected to image formation on said sheet in the image forming unit A, and is discharged to the sheet discharge unit C. In the schematic view shown in FIG. 3A, the sheet feeding unit B and the sheet discharge unit C are respectively positioned below and above the image forming unit A, but they may be inversely positioned respectively above and below the image forming unit. Similar explanation also applies to the structures shown in FIGS. 3B–3D to be explained later.

(2) The image forming apparatus of the present invention described in (1) is also featured by a fact, as shown in FIG. 3B, that a part A2 of the apparatus is openable, at said substantially vertical sheet path D, from the other part A1 of the apparatus, and the main process elements of the image forming unit are incorporated in said the other fixed part A1.

(3) The image forming apparatus of the present invention described in (1) is further featured by a fact, as schematically shown in FIG. 3C, that, in addition to a first sheet feeding unit B1 positioned above or below the image forming unit A, a separate second sheet feeding unit B2 is provided and connected to said substantially vertical sheet path D through a branched sheet path D1, whereby the sheet material can be selectively supplied to said substantially vertical sheet path D from said first sheet feeding unit B1 or second sheet feeding unit B2, and a sheet receiving member of the second sheet feeding unit B2 is foldable into the main body of the apparatus or detachable therefrom.

(4) Also, the image forming apparatus of the present invention described in (1) is further featured by a fact, as schematically shown in FIG. 3D, that, in addition to a first sheet discharge unit C1 positioned above or below the image forming unit A, a separate second sheet discharge unit C2 is provided and is connected to said substantially vertical sheet path D through a branched sheet path D2 whereby the sheet material can be selectively discharged to said first or second sheet discharge units C1, C2, and a sheet receiving member of said second sheet discharge unit C2 is foldable to the main body of the apparatus or detachable therefrom.

The structure (1) (shown in FIG. 3A) substantially avoids extrusion of the sheet feeding unit B or the sheet discharge unit C from any lateral face of the apparatus, thus providing a compact apparatus only requiring a small area for installation.

The substantially vertical sheet path extending from the sheet feeding unit B through the image forming unit A to the sheet discharge unit C can be made substantially straight with U-curved portion, and can be made short, thus reducing the rate of sheet jamming and ensuring quicker output of the first print.

Also the structure (2) (shown in FIG. 3B) enables wide opening of the substantially vertical sheet path or of the interior of the image forming unit at said sheet path, by pulling the movable part A2 apart from the fixed part A1, thereby facilitating the removal of the sheet jammed in said vertical sheet path, the maintenance of the apparatus and the mounting and detaching of the process cartridge.

In this case the main process elements of the image forming unit are incorporated in the fixed part A1 and are therefore not moved in the opening or closing movement of the movable part A2, whereby the precision can be improved and the formation of high-quality image can be easily ensured over a prolonged period. Also the sheet feeding unit and the sheet discharge unit are positioned above and below the fixed part A1 and are not moved nor inclined in the opening or closing movement of the movable part A2, thus avoiding careless dropping of the sheets present in the sheet discharge unit, at the opening operation of the apparatus.

Also the presence of the second sheet feeding unit B2 in the structure (3) (shown in FIG. 3C) allows to feed various sheet materials (not only ordinary-sized sheets, but also special paper, cardboard, postcard etc.) through the selective use of the first and second sheet feeding unit B1 and B2. Said second sheet feeding unit B2 is positioned opposite to the first sheet feeding unit B1 with respect to the substantially vertical sheet path and is extended outwards from the apparatus. However, since such extention exists only on a lateral face of the apparatus, there is required a smaller installation area in comparison with the structure shown in FIG. 1 in which the sheet feeding unit 106 and the sheet discharge unit 119 extend externally from mutually opposite lateral faces of the apparatus. Also when the first sheet feeding unit B1 is exclusively used and the second one is not used, the sheet receiving member thereof can be folded into the main body of the apparatus or detached therefrom to eliminate the outward protrusion of the second sheet feeding unit B2, whereby the installation area of the apparatus can be made smaller.

Also the presence of the second sheet discharge unit C2 in the structure (4) (shown in FIG. 3D) allows to select the sheet discharge in the face-down mode or in the face-up mode, by selective use of the first and second sheet discharge units C1 and C2. Said second sheet discharge unit C2 is externally extended just like the second sheet feeding unit mentioned above. However, such extention exists only on a lateral face of the apparatus, so that there is required a smaller installation area in comparison with the structure shown in FIG. 1 in which protruding members are present on mutually opposite lateral faces. Also when the first sheet discharge unit C1 is exclusively used but the second sheet discharge unit C2 is not used, the sheet receiving member thereof can be folded into the main body of the apparatus or detached therefrom to eliminate the protrusion of said second sheet discharge unit, whereby the installation area of the apparatus can be reduced.

Furthermore, an image forming apparatus with various functions and advantages explained above can be obtained by combining the structure (1) with those (2) to (4).

In summary there can be obtained following advantages:

(1) There is obtained a compact image forming apparatus requiring a small installation area;

(2) The sheet path (substantially vertical one) extending from the sheet feeding unit to the sheet discharge unit can be made substantially straight and short, thus reducing the frequency of sheet jamming and ensuring quicker output of the first print;

(3) The interior of the apparatus can be opened widely at the substantially vertical sheet path extending from the sheet feeding unit to the sheet discharge unit, whereby facilitated is the removal of the jammed sheet, the maintenance of the interior of the apparatus, and the mounting and detaching of the process cartridge;

(4) The main process elements of the image forming unit are incorporated in the fixed part of the apparatus and are not moved nor subjected to vibration at the opening or closing operation of the apparatus whereby the mechanical precision is improved and the formation of high-quality image can be maintained over a long period;

(5) Also, the first sheet feeding unit and the first sheet discharge unit are present in the fixed part of the apparatus and are not subjected to movement, vibration or inclining at the opening or closing operation of the apparatus, so that careless dropping of the sheets from the sheet feeding unit or from the sheet discharge unit even when the apparatus is carelessly opened; and (6) A structure including the second sheet feeding unit or the second sheet discharge unit enables selective feeding of various sheet materials or sheet discharge in the face-down mode and face-up mode.

Furthermore, the present invention is featured as follows in order to attain the foregoing embodiments.

(1) The image forming apparatus of the present invention is featured by a fact that a sheet detecting unit is provided in an upstream position in the sheet transporting direction, with respect to sheet path switch means.

FIGS. 15A and 15B are schematic views of the present invention.

(a) In FIG. 15A, there are shown an image forming unit A; a substantially vertical sheet path D extending through said image forming unit; a sheet feeding unit B provided below said image forming unit A; a first sheet discharge unit C1 provided above said image forming unit A; a second sheet discharge unit C2 positioned opposite to said first sheet discharge unit C1 with respect to said sheet path D; a first branched sheet path E1 for guiding the sheet material from said substantially vertical sheet path to the first sheet discharge unit C1; a second branched sheet path E2 for guiding said sheet material to the second sheet discharge unit C2; sheet path switch means F for selectively connecting said first or second branched sheet path E1 and E2 to the substantially vertical sheet path D; and a sheet detecting unit G provided in an upstream position on the sheet path in the sheet transporting direction with respect to the means F.

(b) As shown in FIG. 15B, there may be employed a layout in which the sheet feeding units B1, B2 are positioned above the image forming unit, and the sheet material is introduced into the substantially vertical sheet path from the upper end for downward transportation and image formation in said image forming unit, and is discharged to the first or second sheet discharge unit C1 and C2 positioned below said image forming unit.

In the above-explained structures in which the sheet material is transported in the substantially vertical sheet path for image formation and is guided, at the end of said sheet path, by the sheet path switch means F into either the first or second branched sheet path E1 or E2 for selective discharge to the first sheet discharge unit C1 or the second unit C2 which are positioned opposite across the substantially vertical sheet path D, the first branched sheet path E1 extending from the end of the substantially vertical sheet path D to the first sheet discharge unit C1 and the second one E2 from said end to the second sheet discharge unit C2 are both short and do not have significant mutual difference in length. Consequently the sheet discharge to either discharge unit can be achieved with stable sheet transportation. It is thus possible to dispense with the intermediate transport rollers or reduce the number thereof, to simplify the structure of the sheet discharge systems, to reduce the cost and to improve the jammed sheet handling.

Also, since the length of the first branched sheet path E1 from the sheet path switch means F to the discharge position to the first sheet discharge unit C1 can be made substantially equal to that of the second branched sheet path E2 from said switch means F to the second sheet discharge unit C2, the sheet discharge to the branched sheet paths E1, E2 and to the sheet discharge units C1, C2 can be detected and confirmed by a single sheet detecting unit G positioned in an upstream position, in the sheet transporting direction, of the switch means F.

As explained in the foregoing, the structures of the present invention, for the image forming apparatus provided with first and second sheet discharge units and capable of selectively discharging the sheet material, subjected to image formation in the image forming unit, to the first or second sheet discharge unit, allows to simplify and compactize the structure of the sheet discharge system from the image forming unit to the first and second sheet discharge units, to achieve secure transportation and discharge of the sheet materials, and to reduce the dimension and cost of the apparatus, thus achieving the aforementioned objects.

Furthermore, the second object of the present invention can be attained in the following manner.

(1) The present invention provides an image forming apparatus comprising at least a sheet feeding slot, first and second sheet discharge slots, and sheet path switch means for selectively switching the path for the sheet material coming out of the image forming unit toward said first or second sheet discharge slot, wherein a sheet feeding member for said sheet feeding slot can assume a first position serving as the sheet feeding member for said slot or a second position folded to the main body of the apparatus and serving as a slot closing door for covering said sheet feeding slot and either of said first and second sheet discharge slots, and said sheet path switch means is adapted, when said sheet feeding member is placed in said second position, to guide the sheet material, coming out of the image forming unit, to the other sheet discharge slot not closed by the sheet feeding member in said second position.

(2) The image forming apparatus of the present invention described in (1) is also featured by the presence of a second sheet feeding unit which, even when the first-mentioned sheet feeding slot and one of the first and second sheet discharge slots are closed by the sheet feeding member of said sheet feeding slot in said second position, enables the sheet feeding to the main body, image formation therein and sheet discharge to the other sheet discharge slot.

(3) The image forming apparatus of the present invention described in (1) is further featured by a fact that, when a sheet receiving member is mounted to a sheet discharge slot that is opened by the movement of the sheet feeding member of the sheet feeding slot to the first position, said sheet path switch means is switched, in response to said mounting, to a state for guiding the sheet material from the image forming unit to said sheet discharge slot.

When the sheet feeding into the main body is not conducted by the sheet feeding slot equipped with the sheet feeding member switchable between the first and second positions, or when the apparatus is not in use or is transported, it is common to shift said sheet feeding member, which is burdensome in the first position, into the folded second position, and said shifting automatically closes the sheet feeding slot and one of the first and second sheet discharge slots. Thus failure in closing does not occur, and the intrusion of foreign articles through said sheet feeding slot or sheet discharge slot can be securely prevented.

When the sheet feeding member is shifted to the second position folded in the main body, the sheet path switch means is shifted in response to the other sheet discharge slot not closed by the sheet feeding member. Therefore, when the image formation is conducted by sheet feeding from the second sheet feeding unit provided in the main body, the sheet material coming out of the image forming unit is guided by thus shifted sheet path switch means to the other sheet discharge slot, whereby the sheet jamming caused by the sheet feeding to the closed discharge slot is definitely prevented.

When the sheet feeding into the main body is to be made by the sheet feeding slot closed by the sheet feeding member placed in the folded second position, said sheet feeding member has always to be shifted to the first position, and said shifting opens said sheet feeding slot and one of the sheet discharge slots. Therefore there is no failure in opening said sheet feeding slot and sheet discharge slot.

When the sheet receiving member is mounted on thus opened sheet discharge slot for effecting the discharge mode with said discharge slot, the sheet path switch means is shifted, in response to said mounting, to a state for guiding the sheet material to said discharge opening. Such linkage between the sheet path switch means and the sheet receiving member avoids the failure of shifting of the sheet path switch means, thereby ensuring the sheet discharge mode through said discharge slot to said sheet receiving member.

The above-explained structures of the image forming apparatus of the present invention avoids, in closing the sheet feeding slots and sheet discharge slots for preventing the intrusion of dusts and foreign articles into the main body, failure in such closing or other inconvenience, thus attaining the object of the present invention.

BRIEF DESCRIPTION OF THE DRAWINGS

FIGS. 13A and 13B are longitudinal cross-sectional views of another embodiment wherein FIG. 12A shows a state in which the sheet feeding tray is opened while FIG. 12B shows a state in which said tray is closed;

DESCRIPTION OF THE PREFERRED EMBODIMENTS

Figure 4:
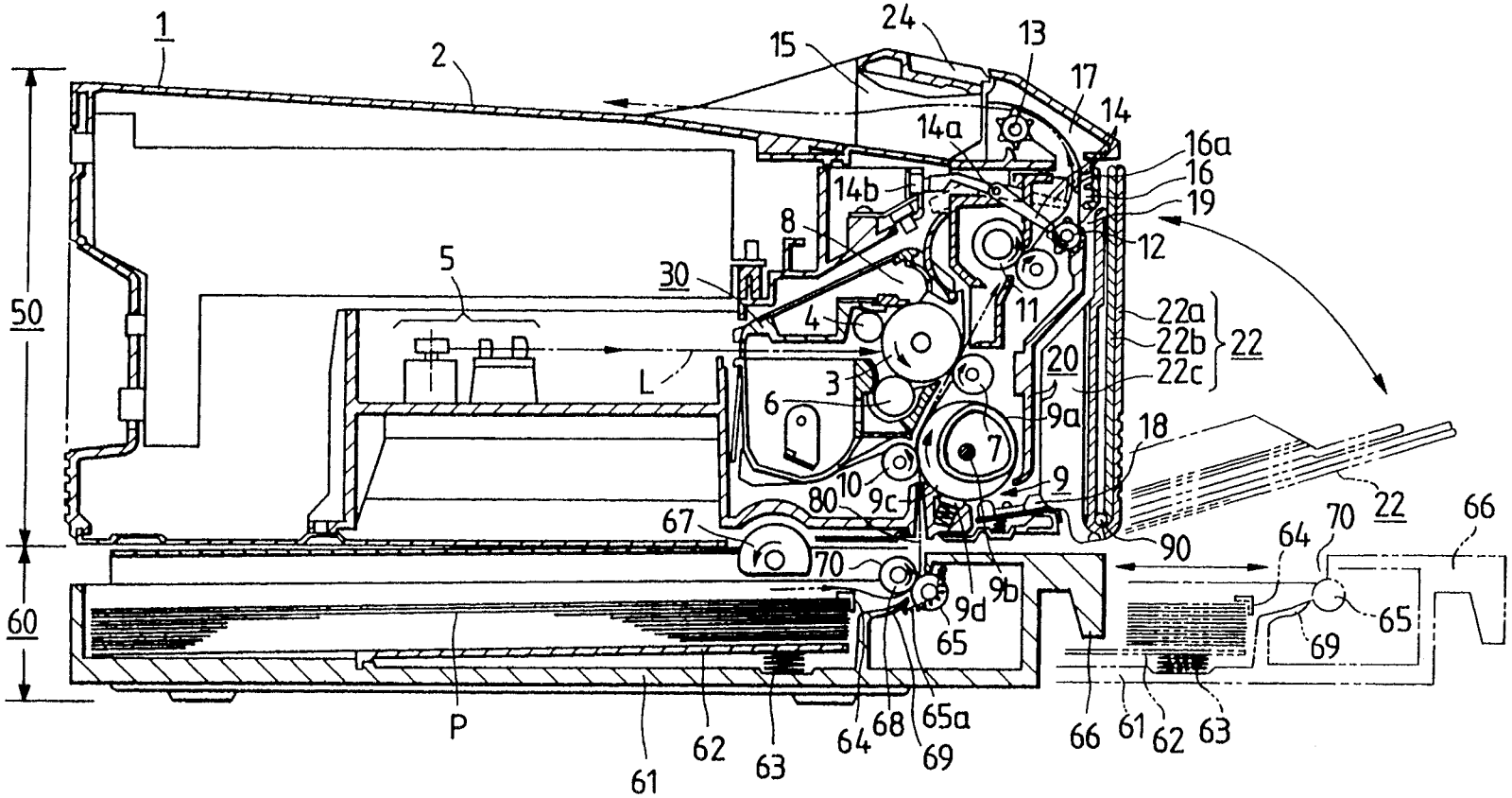
FIG. 4 is a longitudinal cross-sectional view of a printer constituting an embodiment of the present invention.

FIG. 4 is a longitudinal cross-sectional view showing the interior of a laser beam printer utilizing a transfer-type electrophotographic process, as an example of the image forming apparatus.

There are shown a main body 50 incorporating image forming means, and a cassette feeder unit 60 serving as the first sheet feeding unit and positioned below the main body 50.

(1) Cassette Feeder 60

The cassette feeder 60, serving as the first sheet feeding unit, may be integrally constructed with the main body 50 of the printer or may be constructed as a separate unit on which the main body 50 is to be installed at a predetermined position.

The cassette feeder 60 of the present embodiment is provided with a sheet cassette inserting slot at the front side (right-hand end in FIG. 4), whereby a sheet cassette 61 can be inserted as indicated by solid lines or extracted as indicated by double-dot chain lines.

In said sheet cassette 61, there are shown a vertically movable intermidate bottom plate 62 constantly biased by a spring 63 toward the bottom of a sheet stacking part; sheet materials (transfer sheets) P stacked in said stacking part; a separating finger 64 for separating said sheets one by one; a sheet transport roller 65; and a finger grip 66 for handling the cassette.

The main body of the cassette feeder is equipped with a sheet feed roller 67 and a transport roller 68. Said feed roller 67, having a semicircular cross section, is normally in a stand-by position in which the flat portion is positioned downwards, and is rotated by a turn anticlockwise, as indicated by an arrow, in response to each sheet feeding start signal from an unrepresented control system, by an unrepresented drive system through a one-turn clutch. The transport roller 68 is rotated clockwise, as indicated by an arrow, at a predetermined timing and for a predetermined period, by an unrepresented drive system through a clutch controlled by an unrepresented control system.

When the sheet cassette 61 is inserted into the cassette feeder 60 through the slot thereof until said cassette is stopped by a stopper, the transport roller 65 of the cassette 61 is brought into contact with the transport roller 68 of the cassette feeder 60, and said contact state is stably maintained by a spring 65*a* contacting the shaft of said roller 65*a*. In this state the semicircular feed roller 67 is positioned above the rear end portion, in the cassette inserting direction, of the sheet materials P stored in the sheet stacking part of the cassette 61.

Then the one-turn rotation of the semicircular feed roller 67 applies a feeding force, to the uppermost one of the stacked sheets P, in a direction opposite to the cassette inserting direction into the feeder 60, whereby said uppermost sheet is separated, by the separating finger 64, from the following sheets, and is advanced in the upper right direction in FIG. 4.

Said fed sheet material, being guided by an upper curved guide plate 69, enters the nip of the transport rollers 68, 65 in mutually contacting state as explained before, further advanced by the rotation of the roller 68 and accompanying rotation of the roller 65, and is transported upwards through an upward exit 70 of the cassette feeder 60.

The main body 50 of the printer 50 is provided, at the bottom face thereof, with a sheet entrance 80 serving as the first sheet feeding slot, at a position corresponding to the upward exit 70 of the cassette feeder 60. Consequently the sheet transported upwards from the upward exit 70 of the cassette feeder 60 enters the main body 50 through said sheet entrance 80 serving as the first sheet feeding slot.

(II) Main Body 50

In a casing 1 of the main body, an upper plate 2 is formed as a fixed tray serving as the first sheet discharge unit. In said casing there are provided image forming process elements, serving as the image forming means, including an electrophotographic photosensitive member 3 formed as a rotary drum (hereinafter simply referred to as "drum"); a contact charging roller 4 for uniformly charging said drum; a laser beam scanner 5; a developing unit 6; a transfer roller 7; a cleaning unit 8; a sheet separating assembly 9 for separating, one by one, the sheets stacked on a sheet feeding tray 22 serving as the second sheet feeding unit as will be explained later; a sheet transport roller 10 maintained in contact with an idler roller 9*c* of said assembly 9; a fixing unit 11; second and first sheet discharge rollers 12, 13; a sheet detecting lever 14; and electric components of a drive source and a control system.

The sheet material transported upwards from the exit 70 of the cassette feeder 60 into the main body 50 through the entrance 80 serving as the first sheet feeding slot on the bottom of the main body 50, is further transported between the transport roller 10 and the idler roller 9*c*, then between the drum 3 and the transfer roller 7, between fixing rollers of the fixing unit 11, further by the second discharge roller 12 and the first discharge roller 13, and is discharged through a first sheet discharge slot 15 onto the tray 2 formed on the upper face of the casing and serving as the first sheet discharge unit.

The sheet path extending from the sheet entrance 80 serving as the first sheet feeding slot at the bottom of the main body 50 to the first discharge roller 13 is formed as a substantially vertical sheet path positioned, from the bottom plate to the upper plate of the casing, close to the front plate 20 (right-hand end plate in FIG. 4) of the casing 1.

In response to a print start signal, the drum is rotated anticlockwise at a predetermined peripheral speed, and the drum surface is uniformly charged positively or negatively by the contact charging roller 4 and is subjected to scanning exposure by a laser beam L from the laser scanner 5 to form an electrostatic latent image of the object image. Said latent image is subsequently developed into a visible toner image in the developing unit 6.

On the other hand, in the cassette feeder 60, the feed roller 67 is rotated by a turn and also the transport roller 68 is activated, whereby the uppermost one of the stacked sheets P in the cassette 61 is advanced from the upward exit 70 of the feeder 60 to the entrance 80 serving as the first sheet feeding slot on the bottom of the main body 50, and then along said substantially vertical sheet path from the bottom to the top thereof.

Thus the sheet passes through the nip between the transport roller 10 rotated anticlockwise and the idler roller 9*c* of the sheet separating assembly 9 and is introduced between the drum 3 and the transport roller 7, whereby the sheet is subjected to the transfer of the toner image supported on the surface of the drum 3. Thereafter the sheet material is separated from the drum 3, introduced into the fixing unit 11 by a guide member, and is subjected to image fixation by passing between the fixing rollers.

After passing the fixing unit 11, the sheet material pushes up the sheet detecting lever 14 anticlockwise about a shaft 14*c*, as indicated by double-dot chain lines, then passes through the second discharger roller 12 rotated anticlockwise, a first guide face 16*a* of a movable flapper 16 in a first position (shown in enlarged manner in FIG. 9A), a face of a guide member 17 inwardly curved toward the tray 2 serving as the first sheet discharge unit, the first discharge roller 13 rotated anticlockwise and the first sheet discharge slot 15, and is discharged in the face-down mode onto the tray 2 serving as the first sheet discharge unit.

The sheet detecting lever 14, after passing of the rear end of the sheet material coming out of the fixing unit 11, rotates clockwise by its weight about the shaft 14*a* to return to the solid-lined position. The above-explained movement of the lever 14 caused by the passing of the sheet material is detected by a sensor 14*b* such as a photointerruptor, and is utilized for timing control of the sheet, jam detection therefor etc.

Figure 1:
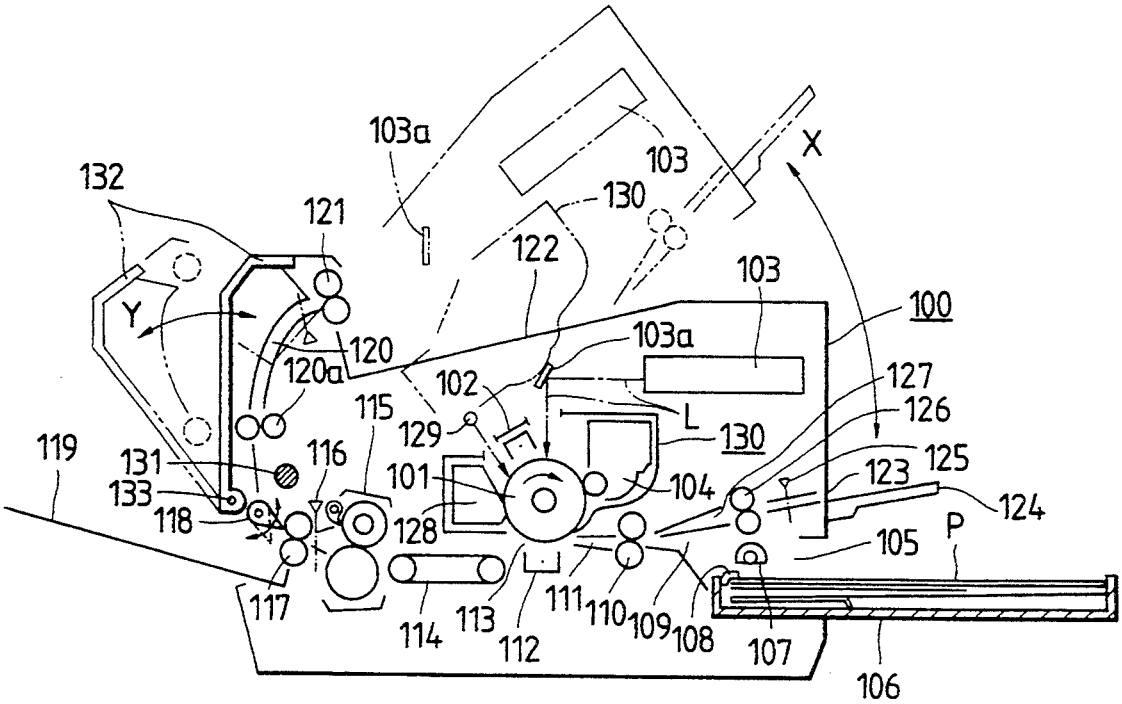
FIG. 1 PRIOR ART
FIGS. 1 and 2 are longitudinal cross-sectional views of conventional printers.
Figure 2:
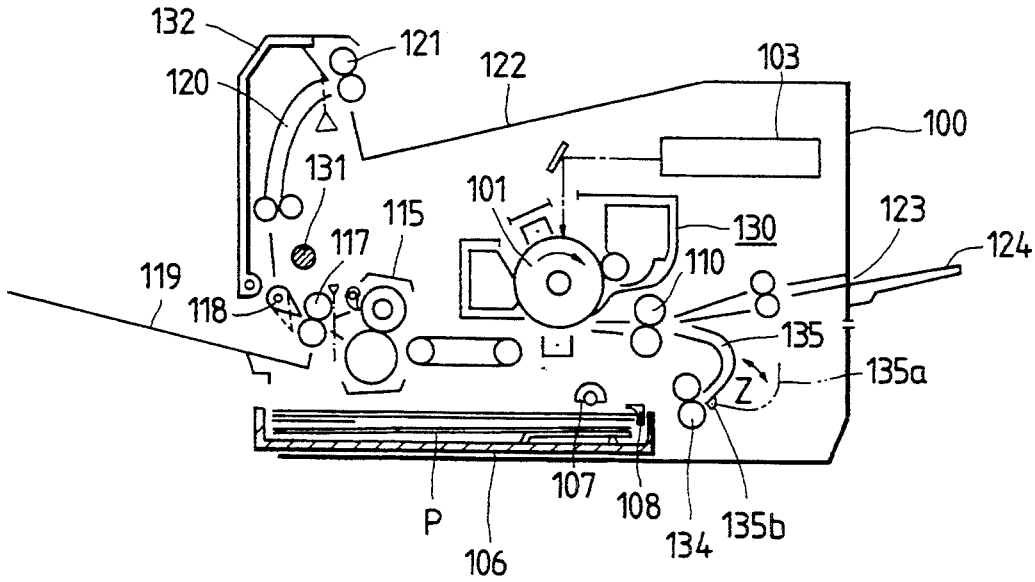
FIG. 2 PRIOR ART
Figure 3A:
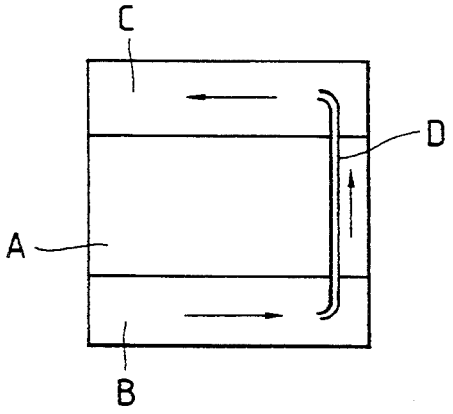
FIGS. 3A to 3D are schematic views of the apparatus of the present invention.

As explained in the foregoing, the printer of the present embodiment is provided with the cassette feeder 60 serving as the sheet feeding unit and the sheet discharge tray 2 as the sheet discharge unit respectively below and above the main body 50 constituting the image forming unit, wherein provided in a substantially vertical sheet path extending from the sheet feeding unit to the sheet discharge unit, and the sheet material supplied from said sheet feeding unit is introduced into said substantially vertical sheet path, then subjected to image formation in the image forming unit and is discharged to the sheet discharge unit. Thus the layout of said apparatus corresponds to that shown in FIG. 3A, and has the effects and advantages explained in the foregoing item (1).

(III) Opening Structure of the Printer

Figure 5:
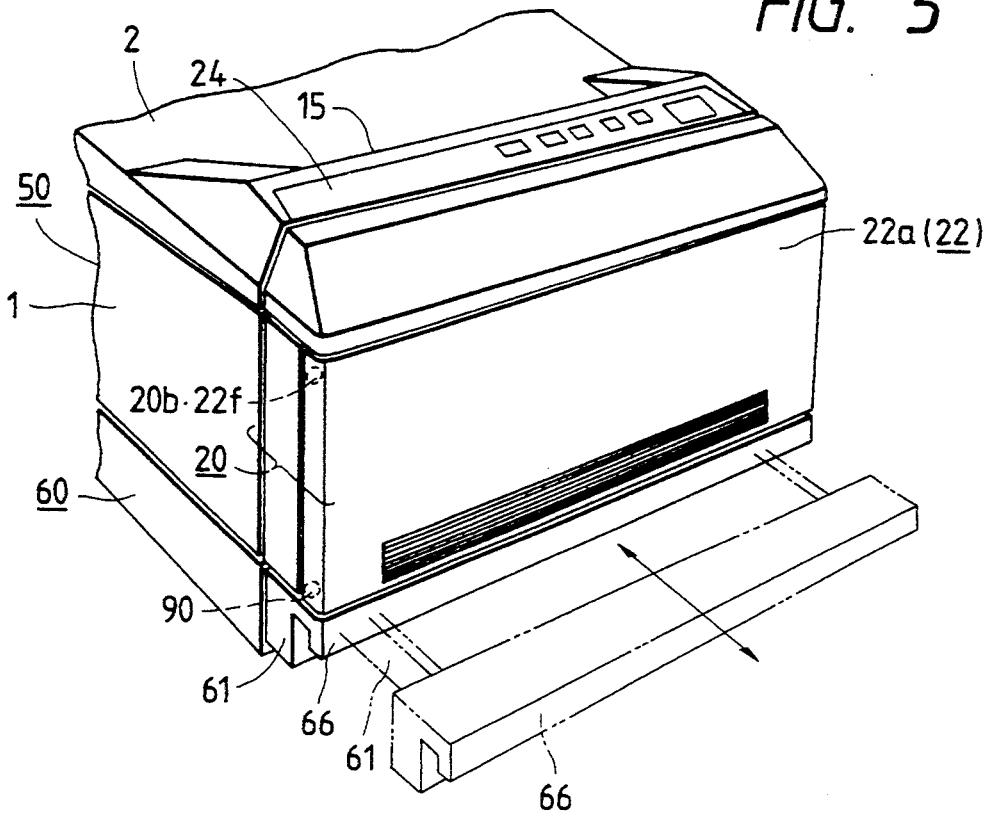
FIG. 5 is a perspective view of the front side of said printer.
Figure 6:
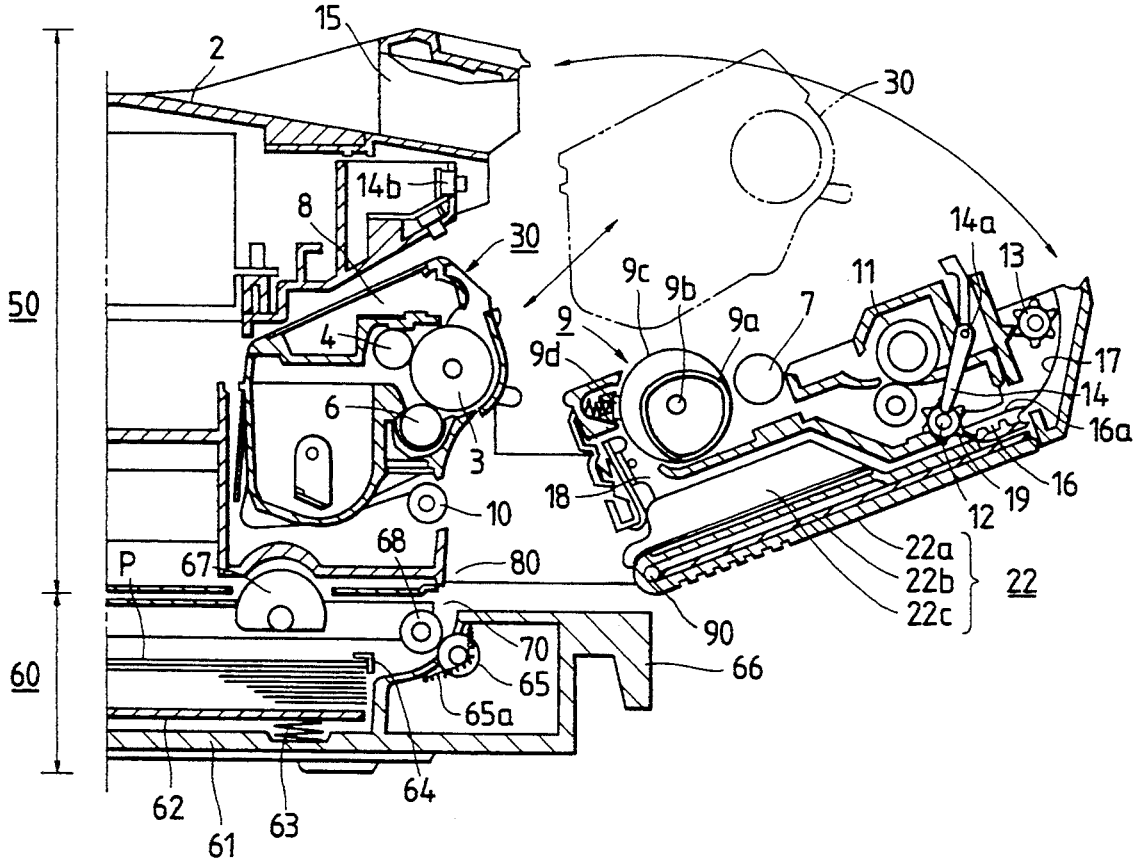
FIG. 6 is a longitudinal cross-sectional view of the printer in a state in which the interior of the printer is exposed by opening a front cover.

In the main body 50 of the printer shown in FIG. 4, the front plate 20 of the casing 1 can be opened from or closed to the front face of the casing 1 by turning about a horizontal hinge shaft 90 provided at the bottom. FIGS. 4 and 5 shows the closed state, while FIG. 6 shows a state in which said front plate is pulled open to expose the interior of the printer.

The image forming process elements present between said substantially vertical sheet path and the front cover plate 20, including the sheet separating assembly 9, transfer roller 7, fixing unit 11, sheet detecting lever 14, second and first discharge rollers 12, 13 are mounted, with predetermined relationship, on the rear face of said front cover plate 20. On the other hand, the process elements present inside the casing 1 beyond said substantially vertical sheet path, including the sheet transport roller 10, drum 3, laser scanner 5, contact charging roller 4, developing unit 6, cleaning unit 8 and main electrical components of the drive and control systems, are mounted with predetermined relationship in the casing 1.

Figure 7:
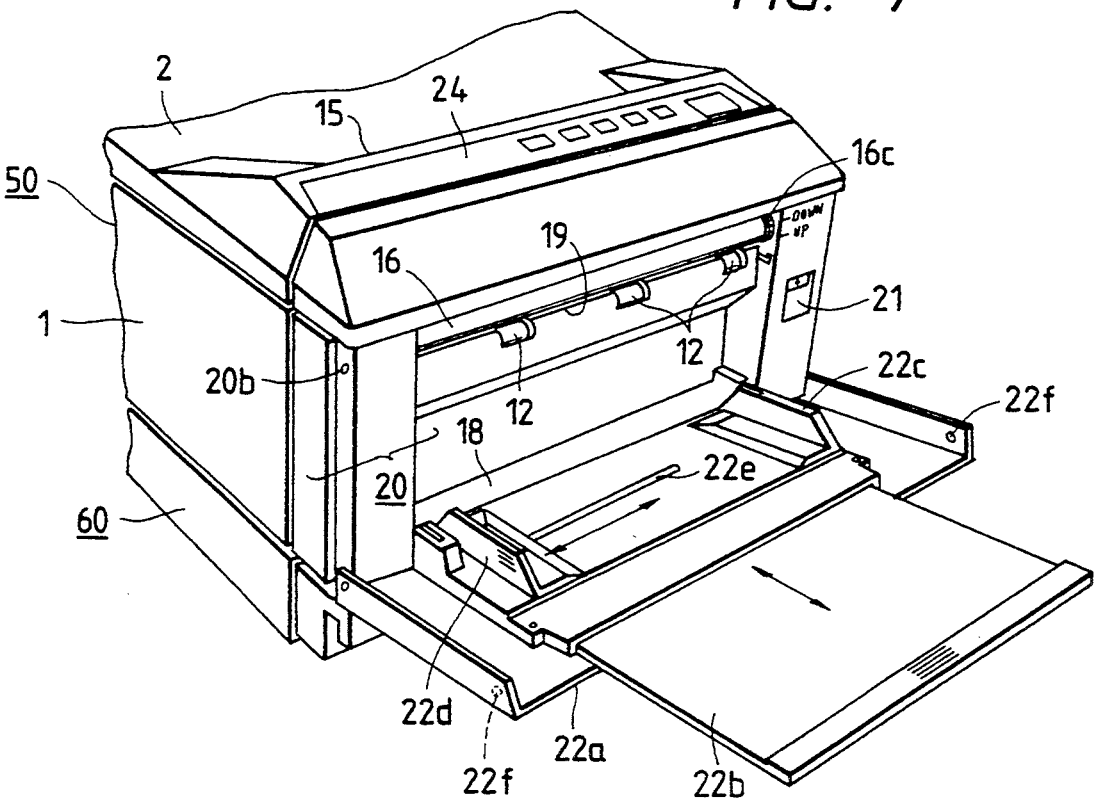
FIG 7. is a perspective view of the front side of said printer in a state in which a sheet feed tray, serving as the second sheet feeding unit, is opened to the outside of the front cover and a sub tray is pulled out.

In the closed state (FIG. 4), the front cover plate 20 is stably maintained by an unrepresented locking mechanism. Referring to FIG. 7, the manipulation of an unlocking lever 21 allows to open the front cover plate 20 about the horizontal hinge shaft 90, as shown in FIG. 6, from the front face of the casing 1 to a full opened state defined by a rotation limiting member, wherein the interior of the main body 50 is fully exposed from said substantially vertical sheet path.

Said opening operation enables the removal of the sheet jammed in said vertical sheet path and the maintenance work in the printer.

In the printer of the present embodiment, the drum 3, contact charging roller 4, developing unit 6 and cleaning unit 8 are mounted with a predetermined relationship in a common cartridge housing to constitute a process cartridge 30, which is detachably mounted in a predetermined position in the main body of the printer. The mounting and detaching of said process cartridge 30 to or from the predetermined position in the casing 1 are conducted by opening the front cover plate 20 as shown in FIG. 6.

Figure 3B:
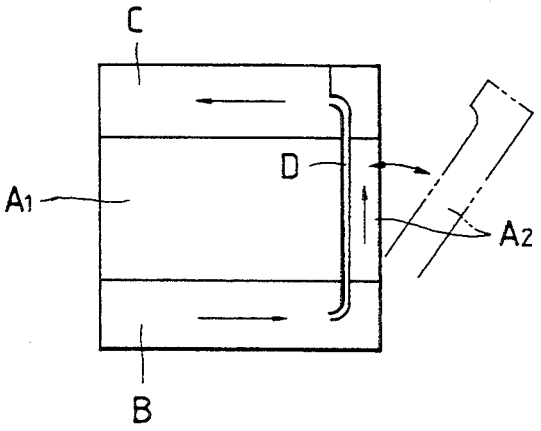

As explained above, in the printer of the present embodiment, the mechanisms positioned between the front cover plate 20 and the substantially vertical sheet path in the main body 50 are rendered openable, while the principal process elements of the image forming unit are incorporated in the fixed casing 1. Thus the printer corresponds to the layout shown in FIG. 3B and has the effects and advantages explained in the foregoing item (2).

(IV) Second Sheet Feeding Unit, Second Sheet Discharge Unit

In FIG. 4 there are further shown horizontal slots 18, 19 respectively provided in a lower position and an upper position of the front cover plate 20 and serving as the second sheet feeding slot and the second sheet discharge slot.

Also provided is a sheet feeding tray 22 serving as the sheet feeding member for said second sheet feeding slot 18. Said tray 22 can be arbitrarily rotated about the lower hinge shaft 90 (also serving as the hinge shaft for the front cover plate 20), between a solid-lined closed position maintained close to the front cover plate 20 and an opened position in which said tray extends externally in a slanted position as indicated by double-dot chain lines, and is supported by a rotation limiting member.

Figure 8:
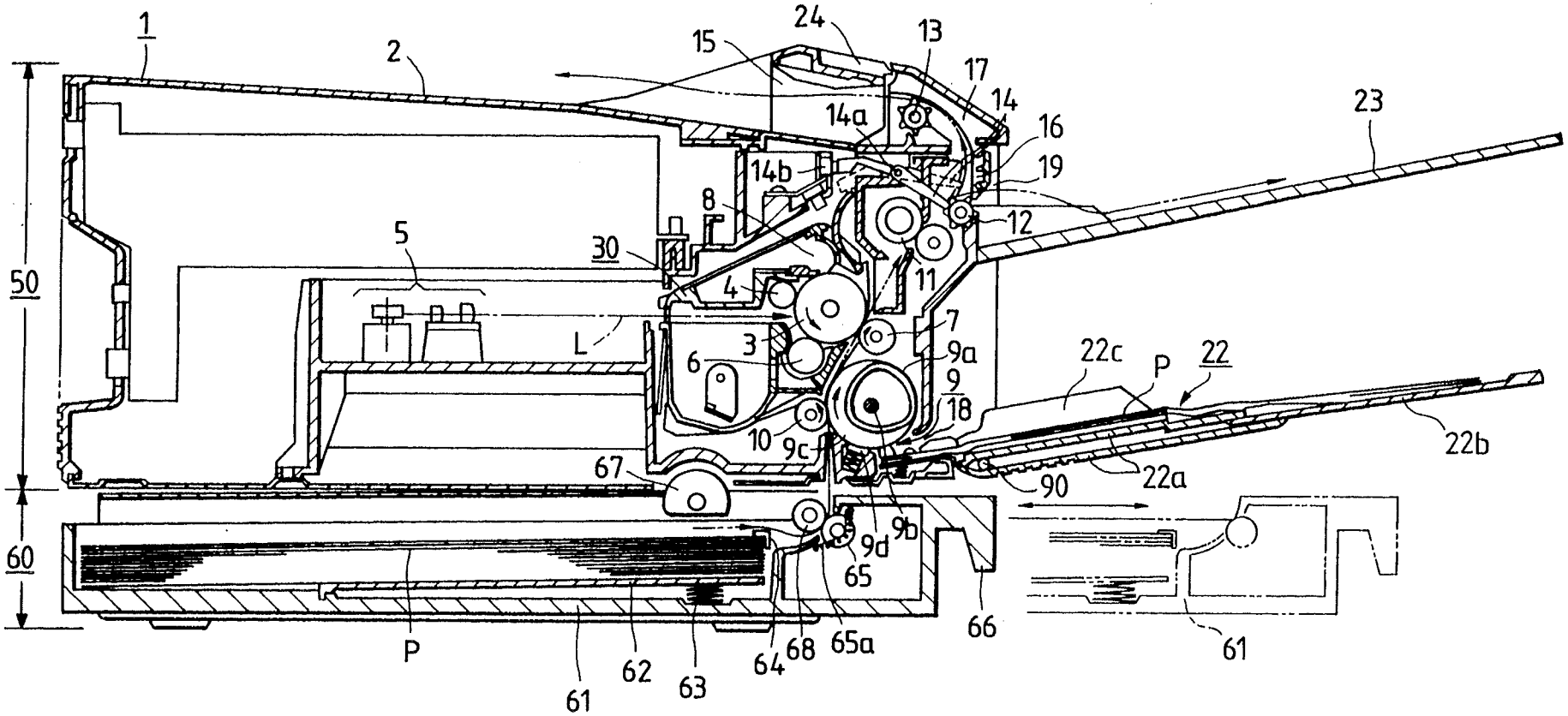
FIG. 8 is a longitudinal cross-sectional view of the printer on which a detachable discharge tray, serving as the second sheet discharge unit, is mounted.

The sheet feeding tray 22 serving as the second sheet feeding unit in the present embodiment is composed of a main tray **22*a*, and a sub tray 22*b* telescopically extendable from said main tray 22*a*. When the main tray 22*a* is pulled open from the front cover plate 20, the sub tray 22*a* can be pulled out to enlarge the longitudinal dimension of the entire tray whereby even large-sized sheets can be stacked thereon. FIGS. 7 and 8 illustrate the sheet feeding tray in said opened state. The main tray 22*a* is provided with lateral guides 22*c*, 22*d* for defining the lateral positions of the stacked sheets, in which the guide 22*c* is fixed while the other guide 22*d* is movable along a transversal guide groove 22*e*, whereby the distance between said guides 22*c*, 22*d*** can be adjusted according to the transversal dimension of the sheet material P to be used.

The sheets P are stacked on the tray 22, with the front end portion being sufficiently inserted into the slot 18 and the lateral edges being defined by the guides **22*c*, 22*d***.

In FIG. 8 there is provided a sheet discharge tray 23, serving as the second sheet discharge unit for the second discharge slot 19. Said tray is detachably mounted at a position corresponding to the slot 19 on the front cover plate 20, by the engagement of a pin **23*a* and a hook 20*a* (FIG. 9**).

Referring to FIG. 8, when a sheet feed mode from the second sheet feeding unit 22 is selected and a print start button is depressed in an operation panel (console panel) 24, the rotation of the drum 3 is started to effect the image formation thereon as already explained in the foregoing.

Figure 10:
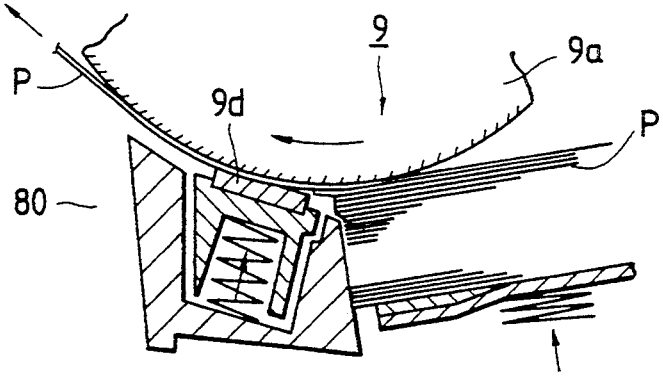
FIG. 10 is an enlarged partial cross-sectional view of a sheet separating assembly, in which a sheet is separated from stacked sheets by a sheet feeding roller and a separating pad.

On the other hand, the feed roller **9*a* of the sheet separating assembly 9 is rotated clockwise by a turn about the shaft 9*b* to apply an advancing force to the uppermost one of the sheets P stacked on the tray 22, and said uppermost sheet alone is separated from other sheets by means of a separating pad 9*d* composed of a friction member and is supplied into the main body through the nip between the separating pad 9*d* and the feed roller 9*a* as shown in FIG. 10. Said sheet is further advanced by the transport roller 10 and the idler roller 9*c*, and is fed to the substantially vertical sheet path of the image forming unit in the same manner as the sheet feeding from the cassette feeder 60 serving as the first sheet feeding unit. Said sheet is then subjected to image transfer by passing between the drum 3 and the transfer roller 7, and to image fixation upon passing through the fixing unit 11**.

Figure 9A:
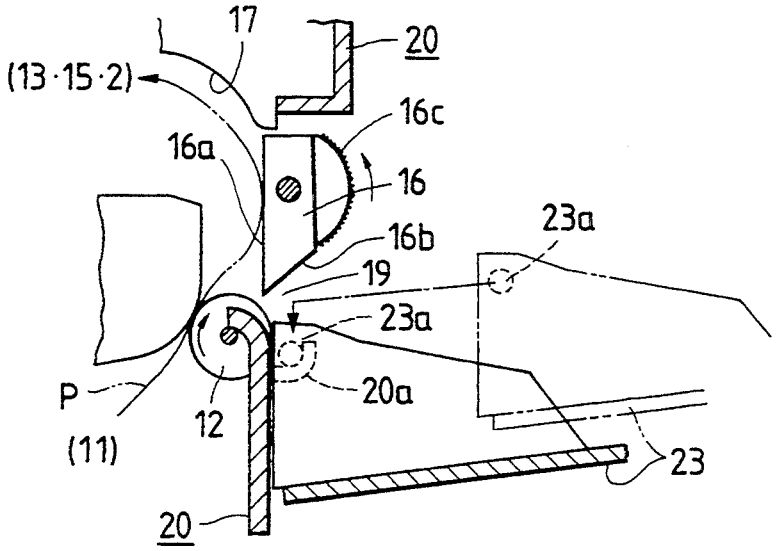
FIGS. 9A and 9B are partial enlarged lateral views respectively showing first and second positions of a movable flapper.

After passing the fixing unit 11 and the second discharge roller 12, if the movable flapper is maintained in the substantially vertical first position as shown in FIG. 9A, the sheet is guided by the first guide face 16*a* thereof toward an inwardly curved guide member 17, then passes the first discharge roller 13 and the first discharge slot 15 and discharged in the face-down mode onto the tray 2 serving as the first sheet discharge unit on the casing 1 of the apparatus.

Figure 9B:
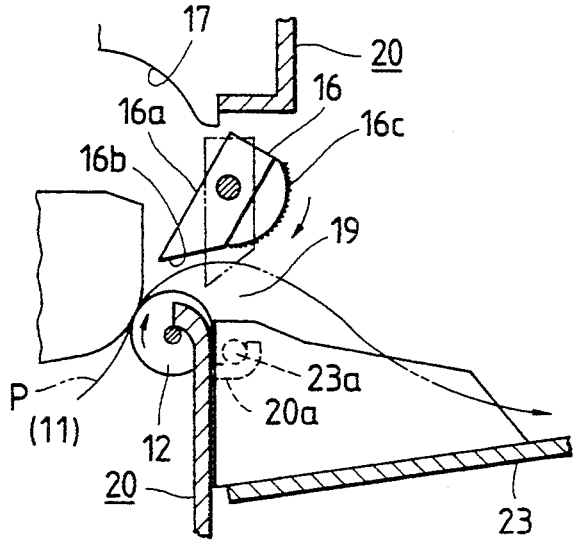

If the movable flapper 16 is in an inclined second position shown in FIG. 9B, the sheet having passed the fixing unit 11 and the second discharge roller 12 is guided by a second guide face 16*b* of said flapper 16, then passes through the second discharge slop 19 of the front cover plate 20 and is discharged in the face-up mode onto the tray 23 constituting the second sheet discharge unit.

The selection of said first or second position of the movable flapper 16 is made by manual rotation of a knob 16*c*.

Figure 3C:
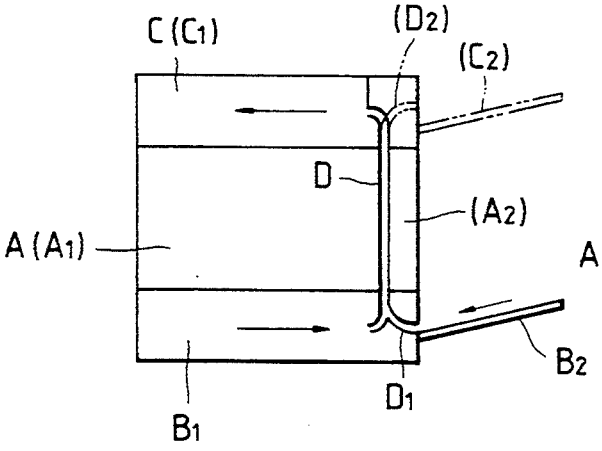
Figure 3D:
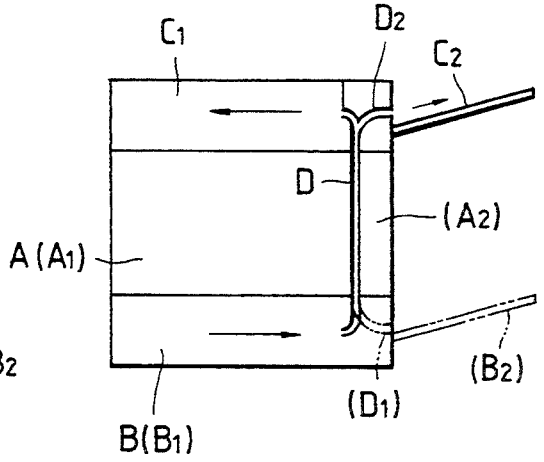

Thus the presence of the sheet feeding tray 22 as the second sheet feeding unit and the sheet discharge tray 23 as the second discharge unit, in addition to the cassette feeder 60 as the first sheet feeding unit and the discharge tray 2 formed on the upper face of the main body as the first sheet discharge unit, provides the effects and advantages of the layout shown in FIGS. 3C and 3D and explained in the foregoing items (3) to (5).

The sheet discharge tray 23 constituting the second sheet discharge unit is detached from the second discharge slot 19 of the front cover plate 20 when not in use. Also if the sheet feeding tray 22 constituting the second sheet feeding unit is not in use, the sub tray 22*b* is pushed toward the main tray 22*a* and then the main tray 22*a* is folded toward the front cover plate 20 to a solid-lined position in FIG. 4, by rotation about the lower hinge shaft 90. This folded state is stably maintained by the engagement of engaging parts 20*b*, 22*f* (FIG. 7) provided on the front cover plate 20 and the main tray 22*a*.

In the folded state of the main tray 22*a* toward the front cover plate 20, the second sheet feeding slot 18 and the second discharge slot 19, provided at the lower and higher portions of the front cover plate 20 are both closed by the folded main tray 22*a*, and are protected from intrusion of dusts or other foreign articles into the main body of the printer.

Also the movable flapper 16 for guiding the sheet material from the fixing unit 11 and the second discharge roller 12 either to the first discharge unit 2 or the second discharge unit 23 may be automatically switched to the first or second position, in linkage with the folding operation of the main tray 22*a* toward the front cover plate 20 or with the mounting operation of the sheet discharge tray 23 on the second discharge slot 19.

Figure 11A:
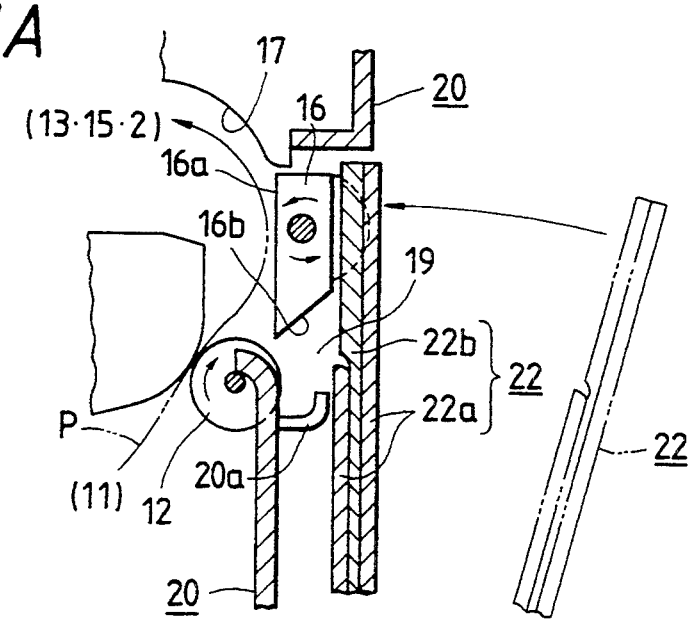
FIG. 11A is an enlarged partial cross-sectional view showing the shifting of the movable flapper to the first position in response to the closing of the movable sheet feeding tray serving as the second sheet feeding unit.

FIG. 11 shows such embodiment. FIG. 11A shows the closing operation of the main tray 22*a* toward the front cover plate 20, whereby the movable flapper 16 is pushed by the inward front end of the folded main tray 22*a* and is thus rotated to the first position. Consequently the sheet material having passed the fixing unit 11 and second discharge roller 12 is guided, by the first guide face 16*a* of said flapper 16, toward the first discharge unit 2.

Figure 11B:
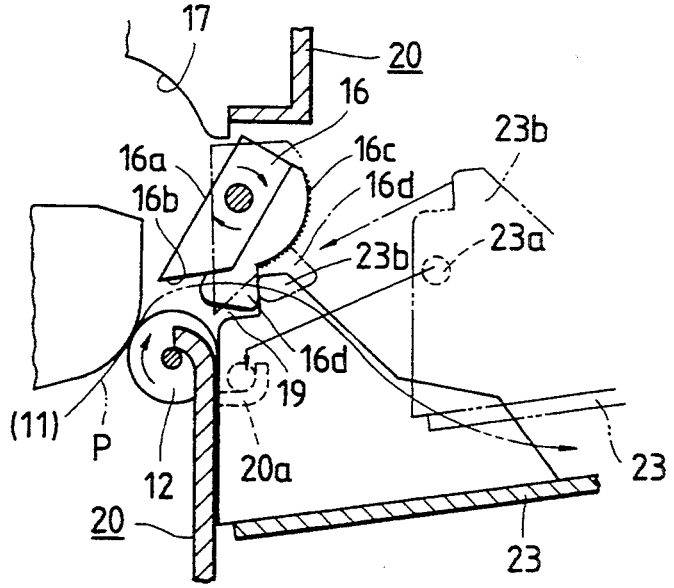
FIG. 11B is an enlarged partial cross-sectional view showing the shifting of the movable flapper to the second position in response to the mounting of the detachable sheet discharge tray.

FIG. 11B shows the mounting operation of the discharge tray 23 to the second discharge slot 19 after the opening of the main tray 22*a*. The movable flapper 16 is shifted from the first position to the second, as a lower protruding part 16*d* of the knob 16*c* is pushed by a part 23*b* of the discharge tray 23, whereby the sheet material, having passed the fixing unit 11 and second discharge roller 12, is guided toward the discharge tray 23 serving as the second sheet discharge unit, through the second discharge slot 19, by the second guide face 16*b* of said movable flapper 16 in the second position.

In the following there will be given a further detailed explanation.

Figure 12A:
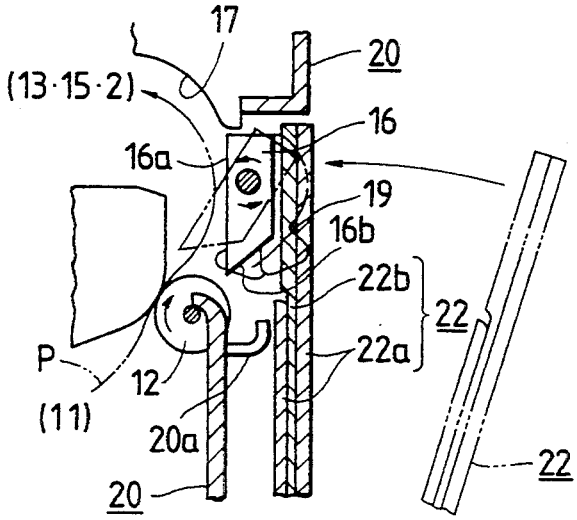
FIG. 12A is an enlarged partial cross-sectional view of a variation, showing the shifting of the movable flapper to the first position in response to the closing of the movable sheet feeding tray serving as the first sheet feeding unit.

In the folded state of the sheet feeding tray 22 toward the front cover plate 20 (solid-lined state in FIG. 4), the movable flapper 16 is maintained in the first position, as the front face thereof is pushed, as shown in FIG. 12A, by the inward end portion of the main tray 22*a*, whereby the sheet material, supplied from the cassette feeder 60 constituting the first sheet feeding unit and having passed the fixing unit 11 and second discharge roller 12, is guided toward the first discharge unit 2, by the first guide face 16*a* of said movable flapper 16 in said first position.

Figure 12B:
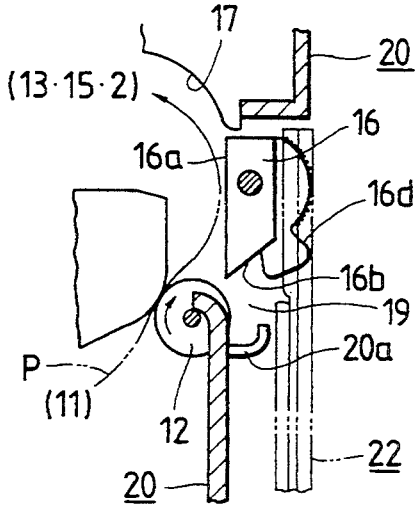
FIG. 12B is a similar view when the sheet feeding tray is opened.

Also when the sheet feeding tray 22 is pulled open from the front cover plate 20, the movable flapper 16 remains in the first position as shown in FIG. 12B.

Figure 12C:
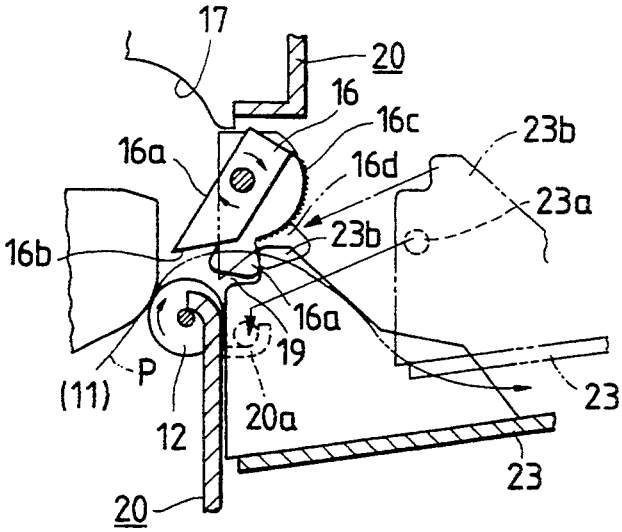
FIG. 12C is an enlarged partial cross-sectional view showing the shifting of the movable flapper to the second position in response to the mounting of the detachable sheet discharge tray.

After said opening of the tray 22, when the sheet discharge tray 23 is mounted on the second discharge slot 19 by the engagement of the pin 23*a* and the hook 20*a*, the movable flapper 16 is shifted from the first position to the second, as shown in FIG. 12C, as the protruding portion 16*d* of the knob 16*c* is pushed by the part 23*b* of said mounted tray 23. Thus the sheet material, having passed the fixing unit 11 and second discharge roller 12, is guided toward the discharge tray 23 constituting the second sheet discharge unit through the second discharge slot 19, by the second guide face 16*b* of the flapper 16 in said second position.

As said flapper 16 is in the second position as shown in FIG. 12C due to the mounting of the discharge tray 23 on the front cover plate 20, the sheet material coming out of the fixing unit 11 and second discharge roller 12 is guided by the second guide face 16*b* of said flapper 16 through the second discharge slot 19 of the front cover plate 20, and is discharged in the face-up mode onto the mounted discharge tray 23 constituting the second sheet discharge unit.

Also when the sheet mateiral is supplied from the cassette feeder 60 serving as the first sheet feeding unit, said sheet material is discharged in the face-up mode onto the discharge tray 23 if it is mounted on the second discharge slot 19 as shown in FIG. 12C.

The face-up sheet discharge onto said discharge tray 23 constituting the second sheet discharge unit is suitable for non-ordinary sheets such as cardboards, postcards, envelopes, overhead projector sheets etc. since the sheet transportation from the fixing unit 11 to the discharge tray 23 is conducted along a relatively straight sheet path. Also such special sheet materials are preferably supplied from the sheet feeding tray 22 constituting the second sheet feeding unit, since the sheet feeding by the tray 22 and the sheet separating assembly 9 provides a short sheet path and is adaptable also to special sheets requiring one-by-one insertion such as the overhead projector sheets, and since the sheet separation by the frictional separating pad 9d can be easily adapted to thick sheets.

If the discharge tray 23 is not mounted on the second discharge slot 19, the sheet material, supplied either from the second sheet feeding unit 22 or from the first sheet feeding unit 60, is guided toward the tray 2 of the first discharge unit by the movable flapper 16 in the first position as shown in FIG. 12B and is discharged in the face-down mode.

(V) Another Embodiment (FIG. 13)

Figure 13A:
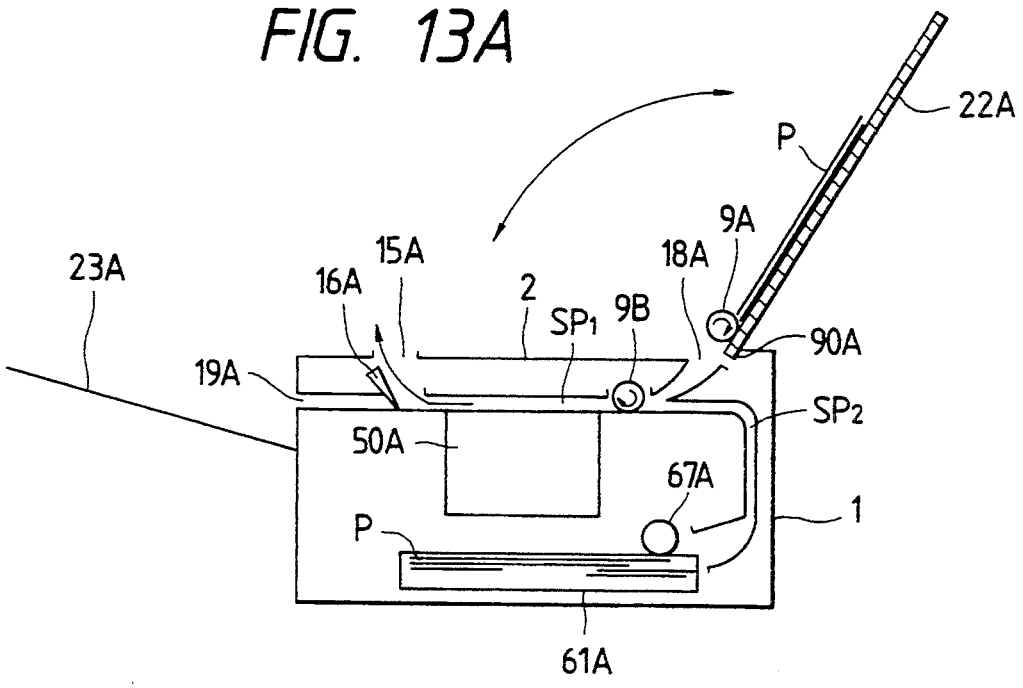
Figure 13B:
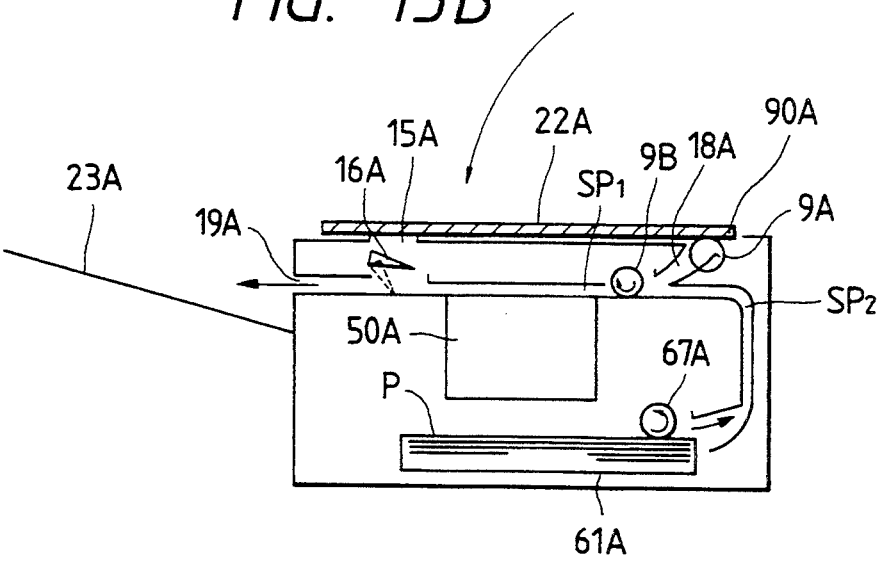

In FIGS. 13A and 13B, there are shown in casing 1 of the image forming apparatus; image forming unit 50A incorporated in said casing; and a first sheet feeding slot 18A and a first sheet discharge slot 15A respectively formed in right and left portions of the upper plate 2 of said casing. A sheet feeding tray 22A, serving as the first sheet feeding unit, is articulated at the base portion thereof by a shaft 90A positioned to the right of said first sheet feeding slot 18A, and is rendered movable between a first position lifted from the upper plate 2 of the casing as shown in FIG. 13A for serving as a sheet feeding member for said first sheet feeding slot 18A, and a second closed position as shown in FIG. 13B. Said sheet feeding member 22A serves as a closing door for the first sheet feeding slot 18A and the first sheet discharge slot 15A in the second position folded to the upper plate 2 of the casing. There are provided a substantially horizontal sheet path SP1 extending in the lateral direction above the image forming means in the casing 1, and a substantially vertical sheet path SP2 positioned close to the right-hand end of the casing 1, and the upper end of said vertical sheet path SP2 communicates with the right end of the horizontal sheet path SP1, of which the left end opens as the second discharge slot 19A, on the left-end wall of the casing 1. The lower end of the vertical sheet path SP2 receives the sheet materials P, supplied one by one from a sheet cassette 61A incorporated as the second sheet feeding unit in a space below the image forming unit 50A in the casing 1. There are further shown a feed roller 9A positioned at the base portion of the sheet feeding tray 22A constituting the first sheet feeding unit; a transport roller 9B provided, in the horizontal sheet path SP1, at an upstream position of the image forming unit 50A; and a flapper 16 serving as sheet path switch means and positioned at a downstream position.

When the sheet feeding tray 22A constituting the first sheet feeding unit is shifted to the first position lifted from the upper plate 2 as shown in FIG. 13A, the flapper 16 is rotated downwards in response to said shifting operation by a link mechanism (not shown), whereby the end portion of said flapper 16 enters the horizontal sheet path SP1 and is maintained in contact with the lower guide plate of said sheet path.

In this state there may be selected a sheet feeding mode from the tray 22A constituting the first sheet feeding unit, or another sheet feeding mode from the sheet cassette 61A constituting the second sheet feeding unit. In the former mode, the sheet materials P on the tray 22A are separated one by one by the feed roller 9A, and the separated sheet enters the horizontal sheet path SP1 through the first sheet feeding slot 18A, then is transported by the transport roller 9B toward the image forming unit 50A for effecting the image formation, and is discharged upwards by the flapper 16A through the first discharge slot 15A.

In the latter mode utilizing the cassette 61A, the sheet material P of the cassette 61A is separated by the feed roller 67A, then enters the vertical sheet path SP2, is subsequently transported through the horizontal sheet path SP1, transport roller 9B, image forming unit 50A and flapper 16A, and is discharged through the first discharge slot 15A.

On the other hand, when the sheet feeding tray 22A of the first sheet feeding unit is shifted to the second position folded along the upper plate 2 of the casing as shown in FIG. 13B, the flapper 16A is rotated upwards, thus being retracted from the horizontal sheet path SP1, in response to said shifting operation by an unrepresented link mechanism. In such state there can only be selected the sheet feeding mode from the cassette 61A constituting the second sheet feeding unit. The sheet material P supplied from the cassette 61A is transported through the vertical sheet path SP2, horizontal sheet path SP1, transport roller 9B, image forming unit 50A and second discharge slot 19A, and the sheet bearing the formed image is discharged onto the discharge tray 23A constituting the second discharge unit. In this case the first sheet feeding slot 18A and the first sheet discharge slot 15A are closed by the sheet feeding tray folded along the upper plate 2, and are protected from the intrusion of dusts or other falling foreign articles into the casing.

(VI) Variation

Figure 14:
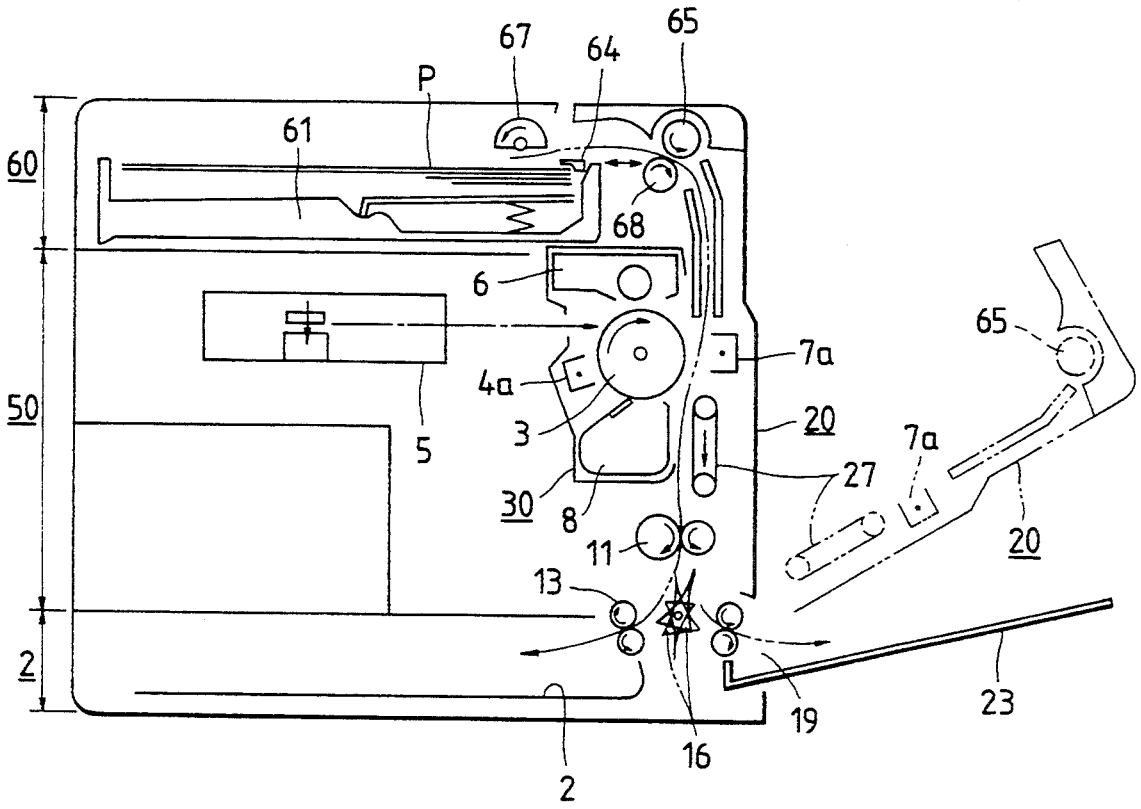
FIG. 14 is a longitudinal cross-sectional view of still another embodiment of the printer.
Figure 15A:
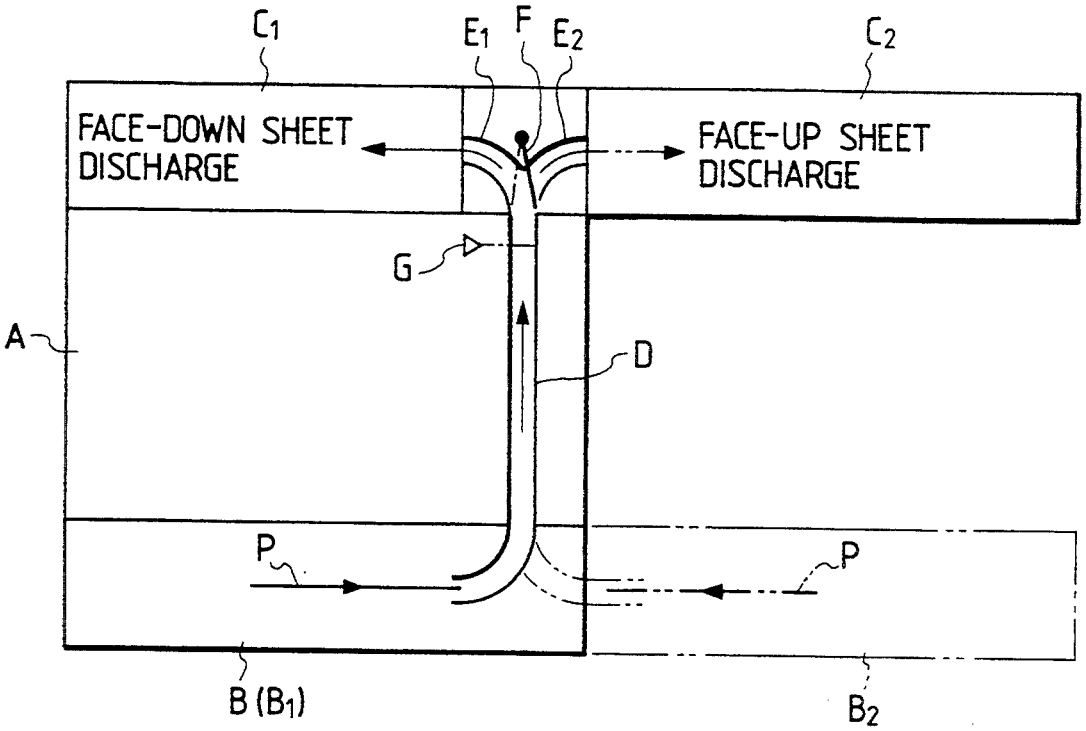
FIGS. 15A and 15B are schematic views of other embodiments of the apparatus of the present invention.
Figure 15B:
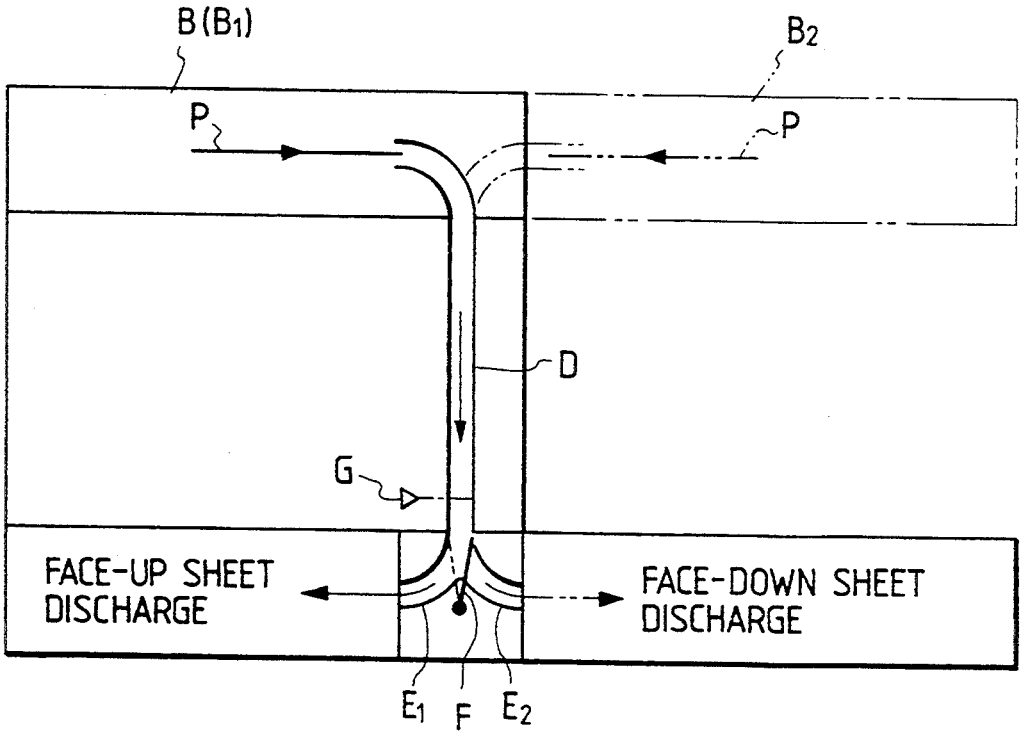

In a printer shown in FIG. 14, there are provided a first sheet feeding unit 60 and a first sheet discharge unit 2 respectively above and below an image forming unit 50, and a substantially vertical sheet path extending from said sheet feeding unit 60 to the sheet discharge unit 2 through the image forming unit 50, wherein the sheet material supplied from said sheet feeding unit 60 is introduced into said substantially vertical sheet path, then is subjected to image formation in said image forming unit 50 and is discharged to said sheet discharge unit 2.

The uppermost sheet of the sheets P in the sheet cassette 61 of the sheet feeding unit 60 is separated by the one-turn rotation of the feed roller 67 and the separating finger 64 and is transported downwards in the substantially vertical sheet path toward the image forming unit 50, by the transport roller 68. In passing between the drum 3 and the transfer charger *7a*, it is subjected to continuous transfer of the image formed on the drum, then transported through a conveyor 27, fixing unit 11, movable flapper in the solid-lined first position, and first discharge roller 13 and discharged in the face-up mode on the tray 2 constituting the first sheet discharge unit.

When a sheet discharge tray 23 serving as the second discharge unit is mounted on the second discharge slot 19 formed in the lower part of the front cover plate 20, the movable flapper 16 is shifted to the second position (shown by double-dot chain lines) whereupon the sheet material coming out of the fixing unit 11 is transported through the second discharge roller 12 and the second discharge slot 19 and is discharged in the face-down mode onto the tray 23 constituting the second discharge unit. Said tray 23, serving as the second discharge unit, is detached or folded to a position in front of the front cover plate 20, when not in use.

What is claimed is:

1. An image forming apparatus having image forming means, sheet feeding means for feeding a stored sheet and transporting means for transporting the sheet fed by said sheet feeding means through an image forming section of said image forming means to a discharge tray, comprising:

sheet storing means provided on a housing of said image forming apparatus at one of an upper portion and a lower portion, relative to the image forming section, for storing said sheet; and support means for partially supporting said transporting means and being openable relative to the housing of said image forming apparatus while leaving said sheet storing means and said discharge tray in said housing, wherein said sheet feeding means feeds the sheet from a side of said support means in one direction while a sheet discharge means discharges the sheet to said discharge tray in a direction reverse thereto.

2. An image forming apparatus according to claim 1, wherein said sheet storing means and sheet discharge tray are disposed substantially horizontally.

3. An image forming apparatus according to claim 1, wherein said sheet storing means and said sheet discharge tray are disposed horizontally, and further comprising sheet supply means for supplying the sheet to said sheet transporting means located at a side of said support means.

4. An apparatus according to claim 3, wherein said sheet supply means further comprises a tray for manual sheet storing and feeding means for feeding sheets from said tray.

5. An image forming apparatus according to claim 1, wherein said transport means transports the sheet substantially vertically.

6. An image forming apparatus according to claim 1, wherein said sheet storing means and sheet discharge tray are disposed substantially horizontally, said transporting means transports the sheet substantially vertically, and further comprising means for guiding said sheet storing means to a position for detachment from said feeding means, said position being on the same side of said image forming apparatus as where said supporting means opens.

7. An image forming apparatus according to claim 1, wherein said sheet storing means is a cassette provided at a bottom portion of said housing of said image forming apparatus, and said sheet discharge tray comprises a stacker provided on an upper surface of said housing of said image forming apparatus.

8. An image forming apparatus according to claim 7, wherein said cassette and said stacker are provided substantially horizontally in said housing of said image forming apparatus.

9. An image forming apparatus according to claim 1, wherein said transporting means has means for conveying the fed sheet to said image forming section, means for delivering the sheet processed at said image forming section to said discharge tray, and guide means for guiding the fed sheet and the processed sheet.

10. An image forming apparatus according to claim 1, further comprising means for guiding said sheet storing means to a position where it is detachable from said feeding means on a side of said image forming apparatus where said supporting means is openable.

11. An image forming apparatus according to claim 1, further comprising a supplemental sheet discharge tray connected through a branched sheet path to said transporting means, said sheet discharge tray and said supplemental sheet discharge tray being located on opposite sides of said transporting means, wherein the sheet can be selectively discharged from said transporting means to one of said sheet discharge tray and said supplemental sheet discharge tray, said supplemental sheet discharge tray being at least one of a foldable tray, a tray storable in said image forming apparatus and a tray detachable from said image forming apparatus; and supplemental sheet storing means connected through a branched sheet path to said transporting means, said sheet storing means and said supplemental sheet storing means being located on opposite sides of said transporting means, wherein the sheet can be selectively fed to said transporting means from either one of said sheet storing means, and a sheet storing member of the supplemental sheet storing means is at least one of foldable, storable in said image forming apparatus, and detachable from the image forming apparatus.

12. An image forming apparatus according to claim 1, wherein said image forming means comprises a printer.

13. An image forming apparatus according to claim 1, further comprising:

a sheet path constructing said transporting means and extending substantially vertically from said sheet storing means through said image forming section to said sheet discharge tray; and a second sheet storing means connected through a branched sheet path to said substantially vertical sheet path, said sheet storing means and second sheet storing means being located on opposite sides of said substantially vertical sheet path, wherein the sheet can be selectively fed to said substantially vertical sheet path from one of said sheet storing means and said second sheet storing means, and a sheet storing member of said second sheet storing means is at least one of foldable and storable in the housing and detachable therefrom.

14. An apparatus according to claim 13, wherein said substantially vertical sheet path is rendered openable with respect to a housing of the apparatus.

15. An image forming apparatus according to claim 13, wherein said sheet storing means and sheet discharge tray are disposed substantially horizontally.

16. An image forming apparatus according to claim 1, further comprising:

a sheet path constructing said transporting means and extending substantially vertically from said sheet storing means through said image forming section to said first sheet discharge tray; and a second sheet discharge tray connected through a branched sheet path to said substantially vertical sheet path, said second sheet discharge tray being located at an opposite side of said substantially vertical sheet path from said first sheet discharge tray, wherein the sheet can be selectively discharged from said substantially vertical sheet path to one of said sheet discharge tray and said second sheet discharge tray, and said second sheet discharge tray is at least one of foldable and storable in said housing of said image forming apparatus and detachable from said housing of said image forming apparatus.

17. An apparatus according to claim 16, further comprising second sheet storing means connected through a branched sheet path to said substantially vertical sheet path, wherein the sheet can be selectively fed to said substantially vertical sheet path from one of said sheet storing means and said second sheet storing means, and a sheet storing member of the second sheet storing means is at least one of foldable and storable in said housing of said image forming apparatus and detachable from said image forming apparatus.

18. An apparatus according to claim 16, wherein said substantially vertical sheet path is rendered openable with respect to said housing of said image forming apparatus.

19. An apparatus according to claim 17, wherein said substantially vertical sheet path is rendered openable with respect to said housing of said image forming apparatus.

20. An image forming apparatus according to claim 16, wherein said sheet storing means and said first sheet discharge tray are disposed substantially horizontally.

21. An image forming apparatus according to claim 1, further comprising:

a sheet path extending substantially vertically from said sheet storing means through said image forming section to said sheet discharge tray;

a second sheet discharge tray connected through a branched sheet path to said substantially vertical sheet path, said sheet discharge tray and said second sheet discharge tray being located on opposite sides of said substantially vertical sheet path; wherein the sheet can be selectively discharged from said substantially vertical sheet path to one of said sheet discharge tray and said second sheet discharge tray, and said second sheet discharge tray is at least one of foldable and storage in said housing of said image forming apparatus and detachable from said image forming apparatus; and second sheet storing means of a manual insertion type connection through a branched sheet path to said substantially vertical sheet path, said sheet storing means and said second sheet storing means being located at opposite sides of said substantially vertical sheet path, wherein the sheet can be selectively fed to said substantially vertical sheet path from one of said first sheet storing means and said second sheet storing means, and a sheet storing member of the second sheet storing means is at least one of foldable and storable in said housing of said image forming apparatus, and detachable from said housing of said image forming apparatus, and wherein said substantially vertical sheet path is rendered openable with respect to said housing of said image forming apparatus, and principal process elements of said image forming section are incorporated in said housing of said image forming apparatus; and a supply opening for allowing insertion and removal of said first sheet storing means, said supply opening located on said housing at a side of said one part.

22. An image forming apparatus according to claim 21, wherein said sheet storing means and said first sheet discharge tray are disposed substantially horizontally.

23. An image forming apparatus according to claim 21, further comprising:

sheet path switch means for selectively guiding the sheet coming out of the image forming section toward one of said sheet discharge trays, said sheet path switch means, in response to shifting of said sheet storing member to a folded position, being switched to a state for guiding the sheet coming out of the image forming section toward one of said sheet discharge tray not closed by the sheet storing member shifted to said folded position.

24. An image forming apparatus according to claim 23, wherein said sheet path switch means is adapted, in response to mounting of said second sheet discharge tray to a sheet discharge outlet opened by the shifting of the sheet storing member to an open position, to be switched to a state for guiding the sheet toward said second sheet discharge tray.

25. An image forming apparatus according to claim 21, further comprising:

a first branched sheet path and a second branched sheet path for guiding a sheet which is subjected to image formation in said substantially vertical sheet path to said first sheet discharge tray or said second sheet discharge tray, respectively; and sheet path switch means for selectively connecting said substantially vertical sheet path with one of said first branched sheet path and said second branched sheet path.

26. An image forming apparatus according to claim 25, further comprising sheet detecting means upstream in the sheet transporting direction of said sheet path switch means.

* * * * *

UNITED STATES PATENT AND TRADEMARK OFFICE

CERTIFICATE OF CORRECTION

PATENT NO. : 5,418,606 
DATED : May 23, 1995
INVENTOR(S) : Yutaka Kikuchi, et al.

It is certified that error appears in the above-indentified patent and that said Letters Patent is hereby corrected as shown below:

On the title page, items

[56] RC,
line USPD, "4,750,016 6/1988 Ksumoto et al." should read --4,750,016 6/1988 Kusumoto et al.--.
[57] ABSTRACT,
line 8, "and" should read --or--.

Column 1,
line 42, "deflects" should read --deflect--.

Column 4,
line 42, "dusts" should read --dust--.

Column 9,
line 52, "avoids," should read --avoid,--.

Column 11,
line 2, "intermidate" should read --intermediate--.

Column 13,
line 8, "in" should read --is--.

UNITED STATES PATENT AND TRADEMARK OFFICE

CERTIFICATE OF CORRECTION

PATENT NO. : 5,418,606

DATED : May 23, 1995

INVENTOR(S) : YUTAKA KIKUCHI, ET AL.

It is certified that error appears in the above-indentified patent and that said Letters Patent is hereby corrected as shown below:

Column 15,
line 14, "slop 19" should read --slot 19--.

Column 18,
line 19, "dusts" should read --dust--.

Column 21,
line 26, "storage" should read --storable--.

Column 22,
line 19, "tray" should read --trays--.

Signed and Sealed this

Thirty-first Day of October 1995

Attest:

Bruce Lehman

BRUCE LEHMAN

Attesting Officer

Commissioner of Patents and Trademarks